US008256766B2

(12) United States Patent
Iwata

(10) Patent No.: US 8,256,766 B2
(45) Date of Patent: Sep. 4, 2012

(54) SHEET ALIGNING MECHANISM, STACKER, IMAGE FORMING APPARATUS, AND IMAGE FORMING SYSTEM

(75) Inventor: Hirotaka Iwata, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 305 days.

(21) Appl. No.: 12/591,111

(22) Filed: Nov. 9, 2009

(65) Prior Publication Data

US 2010/0117292 A1 May 13, 2010

(30) Foreign Application Priority Data

Nov. 13, 2008 (JP) ..... 2008-290733
Jun. 1, 2009 (JP) ..... 2009-132026

(51) Int. Cl.
*B65H 31/26* (2006.01)

(52) U.S. Cl. ..... 271/220; 271/221; 271/222; 271/223; 414/788.9

(58) Field of Classification Search ..... 271/220, 271/221, 222, 223; 414/788.9, 789.1
See application file for complete search history.

(56) References Cited

U.S. PATENT DOCUMENTS 5,188,353 A * 2/1993 Parks ..... 271/184
6,296,247 B1 10/2001 Tamura et al.
6,494,449 B2 12/2002 Tamura et al.
6,871,851 B2 3/2005 Tamura et al.
6,889,974 B2 5/2005 Tamura et al.
7,014,183 B2 3/2006 Tamura et al.
7,954,808 B2 * 6/2011 Tomida ..... 271/207
2007/0176357 A1 8/2007 Horio et al.

FOREIGN PATENT DOCUMENTS

JP 2003-312931 11/2003
JP 4091789 3/2008

OTHER PUBLICATIONS

Abstract of JP 2003-312930 published Nov. 6, 2003.

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

A sheet aligning mechanism that aligns sheets of paper includes, in a shift tray, a pair of main joggers and a pair of sub joggers, which are arranged downstream of the main joggers in a sheet discharge direction, for use in width-direction alignment of the sheets. One of the sub joggers is configured to move from a position where the sub jogger is not upwardly receded to an upwardly-receded position so that the thus-opened up space, of which height corresponds to a height difference between the two positions, can be utilized for sheet removal.

17 Claims, 13 Drawing Sheets

SHEET ALIGNING MECHANISM, STACKER, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2008-290733 filed in Japan on Nov. 13, 2008 and Japanese Patent Application No. 2009-132026 filed in Japan on Jun. 1, 2009.

BACKGROUND OF THE INVENTION

1. Field of the Invention

The present invention relates to a sheet aligning mechanism that aligns sheets discharged into a tray, a stacker that includes the sheet aligning mechanism and sequentially stacks sheets discharged from a sheet discharging unit into an elevatable shift tray, an image forming apparatus and an image forming system including the stacker.

2. Description of the Related Art

Some image forming apparatuses, such as a copier and a printer, is provided with a stacker, which is a type of post-processing apparatus, that stacks a large number of sheets of ordinary paper or the like discharged from the image forming apparatus into an elevatable shift tray.

Some type of the stacker includes a sheet aligning mechanism that aligns sheets stacked on the shift tray in a sheet width direction (direction perpendicular to a sheet discharge direction). For example, a stacker that includes a jogger that aligns an outer side in the sheet width direction of sheets and a leading-end stopper that aligns side ends, which are ends in the sheet discharge direction, of the sheets is disclosed in Japanese Patent Application Laid-open No. 2003-312930 and Japanese Patent Application Laid-open No. 2003-312931.

However, the conventional stacker is disadvantageous in requiring space to prevent, when a sheet is picked up from sheets stacked in a shift tray, the stacked sheets from coming into contact with the jogger and thereby going out of alignment. The space has conventionally been provided only by lowering the shift tray.

To provide the space, it has been necessary to set a relatively large lowering distance for the shift tray, which entails reduction in the number of sheets that can be loaded on the shift tray, upsizing of an apparatus so as not to reduce the number of sheets that can be loaded, or placing a limit on the height of a transport unit arranged above a loading portion of the shift tray. This makes removal of a jammed sheet less easy or requires additional space only for use in the sheet removal rather than sheet stacking.

SUMMARY OF THE INVENTION

It is an object of the present invention to at least partially solve the problems in the conventional technology.

According to one aspect of the present invention, there is provided a sheet aligning mechanism that aligns sheets discharged from a sheet discharging unit into a tray. The sheet aligning mechanism includes a first width-direction aligning unit arranged near the sheet discharging unit, for aligning end faces of the sheets in a sheet width direction perpendicular to a sheet discharge direction and a second width-direction aligning unit arranged downstream of the first width-direction aligning unit in the sheet discharge direction. Each of the first width-direction aligning unit and the second width-direction aligning unit includes a pair of aligning members and an upward receding mechanism that causes one of the aligning members to upwardly recede from a sheet-alignment operating position.

With this configuration, aligning members are upwardly receded from sheet-alignment operating positions, thereby lessening space that can be used only for sheet removal. This allows an increase in the number of sheets that can be loaded, compact construction of an apparatus, and allocating space opened up by lessening the space to space for removal of a jammed sheet or the like. Accordingly, a sheet aligning mechanism of favorable operability adapted to an intended use is provided.

Furthermore, according to another aspect of the present invention, the upward receding mechanisms of the first width-direction aligning unit and the second width-direction aligning unit cause at least an aligning member on a sheet removing side to recede.

With this configuration, an aligning member on only a sheet removing side of the aligning members is configured to recede so that an amount of additional cost due to an increase in the number of components is reduced and compact construction of the mechanism and the like are allowed.

Moreover, according to still another aspect of the present invention, the upward receding mechanism of the second width-direction aligning unit causes an aligning member to upwardly recede when the aligning member is positioned outside a sheet-alignment operating range in the sheet width direction.

With this configuration, the aligning members are upwardly receded outside a range, in which alignment operation is performed, irrespective of a sheet size and the like. This allows to fix positions where the aligning members are upwardly receded in the sheet width direction.

Furthermore, according to still another aspect of the present invention, the sheet aligning mechanism further includes a drive unit that moves the aligning members of the first width-direction aligning unit and the second width-direction aligning unit in the sheet width direction and drives the upward receding mechanism to cause the aligning members of the second width-direction aligning unit to upwardly recede.

With this configuration, it is possible to cause the aligning members to recede without providing an additional drive unit for causing the aligning members to upwardly recede in the upward receding mechanism.

Moreover, according to still another aspect of the present invention, the upward receding mechanism of the second width-direction aligning unit includes a slider to which the aligning members are rotatably attached, the slider being driven by the drive unit, a projection arranged on one of the aligning members such that the projection extends parallel to a moving direction of the slider, and a sloped guide member arranged in an end portion of a moving range of the aligning member at a position where the sloped guide member opposes a distal end of the projection. The projection is moved with the distal end in sliding contact with the sloped guide member, thereby rotating the aligning member to cause the aligning member to upwardly recede.

With this configuration, not only operations of the aligning members are stabilized but also a need of providing a drive unit only for use by a slider is eliminated.

Furthermore, according to still another aspect of the present invention, a speed at which the aligning members move in the sheet width direction for sheet alignment is set to a value that is different from a speed at which the aligning members move in the sheet width direction for upward receding.

With this configuration, a drive unit produces a sufficiently high torque to allow an additional load to be placed on the drive unit to perform the upward receding operation of the aligning members, thereby increasing reliability. This also reduces an amount of additional cost due to upsizing of the drive unit and allows compact construction of the mechanism.

Moreover, according to still another aspect of the present invention, the aligning member is configured to move within an alignment range and return to the sheet-alignment operating position by gravity when the distal end of the projection comes out of contact with the sloped guide member.

With this configuration, when a distal end of a projection comes out of contact with a sloped guide member, the projection returns to an alignment operating position by gravity. This eliminates a need of providing a special return member, thereby reducing an amount of additional cost due to an increase in the number of components and allowing compact construction of the mechanism.

Furthermore, according to still another aspect of the present invention, the slider includes a stopper that comes into contact with the aligning member when the aligning member has returned to the sheet-alignment operating position by gravity.

With this configuration, a degree of rocking motion of the aligning member in a returning direction that occurs when the aligning member returns is reduced and thereby the position of the aligning member is stabilized relatively early. This prevents malfunctioning of the mechanism and a decrease in alignment accuracy as a consequence of the malfunctioning, as well as prevents decrease in productivity due to extension of a period of time required for stabilization.

Moreover, according to still another aspect of the present invention, a rotation center of gravity of the aligning member is positioned so as to cause, when the aligning member returns from a receded position to the sheet operating position, the aligning member to return farther than the sheet operating position, thereby causing the aligning member to be kept in contact with the stopper of the slider.

With this configuration, a position of the aligning member is stabilized as well as rocking (swinging) motion of the aligning member that occurs when the aligning member is moved in the width direction is prevented and reduced. This prevents malfunctioning of the mechanism and a decrease in alignment accuracy as a consequence of the malfunctioning and thereby improves alignment accuracy.

Furthermore, according to still another aspect of the present invention, the second width-direction aligning unit includes a sheet-width-direction detecting member, and a home position of each of the aligning members is set to outside of a sheet alignment range in the width direction and inside a position where the aligning member upwardly recedes.

With this configuration, home positions of the aligning members are set to outside a width-direction alignment range and inside positions where upward receding is performed. This allows to cause the aligning members to upwardly recede only when required, thereby increasing durability of the projection and the sloped guide portion that are brought into sliding contact with each other.

Moreover, according to still another aspect of the present invention, the second width-direction aligning unit includes a sheet-width-direction detecting member, and a home position of each of the aligning members is set to a position where the aligning member upwardly recedes.

With this configuration, the aligning members are constantly upwardly receded when a job is completed or a like occasion. Therefore, the need of additionally providing an input unit for performing the upward receding is eliminated, which leads to reduction of cost and facilitation of control.

Furthermore, according to still another aspect of the present invention, the sheet aligning mechanism further includes a shift unit that shifts batches of sheets to be discharged to different positions in the sheet width direction on a batch-by-batch basis.

With this configuration, assortment of sheets on a batch-by-batch basis is facilitated.

Moreover, according to still another aspect of the present invention, there is provided a stacker that sequentially stacks sheets discharged from a sheet discharging unit into an elevatable tray. The stacker includes a sheet aligning mechanism according to the present invention.

With this configuration, space that can be used only for sheet removal is lessened. This allows an increase in the number of sheets that can be loaded, compact construction of the apparatus, and allocating space opened up by lessening the space to space for removal of a jammed sheet or the like. Accordingly, a stacker of favorable operability adapted to an intended use is provided.

Furthermore, according to still another aspect of the present invention, the stacker further includes a tray-shift start switch for starting shifting of the tray from a sheet stacking position to a sheet removal position when a sheet is to be removed. The upward receding mechanism of the width-direction aligning unit of the sheet aligning mechanism is configured to be driven to perform an upward receding operation of the aligning member when the tray-shift start switch is switched on.

With this configuration, it is possible to cause the aligning members to upwardly recede when required to remove a sheet without additionally providing a dedicated input unit without making an effort to reduce cost due to addition of a dedicated component.

Moreover, according to still another aspect of the present invention, the stacker further includes a door arranged in a sheet removing unit of a stacker body and a door-opening detecting member that detects whether the door is open, the door-opening detecting member being arranged in the stacker body. The upward receding mechanism of the width-direction aligning unit of the sheet aligning mechanism is configured to perform an upward receding operation of the aligning member when the door-opening detecting member detects that the door is open.

With this configuration, it is possible to cause the aligning members to upwardly recede without additionally providing a dedicated input unit, thereby reducing an amount of cost increase due to addition of a dedicated component in addition to allowing sheet removal, expansion of an area accessible for a user in opening a door, and improvement in operability for the user.

Furthermore, according to still another aspect of the present invention, there is provide an image forming apparatus that includes a stacker according to the present invention inside a sheet discharge device.

With this configuration, even when the stacker is added to the apparatus, an amount of increase in the size of the entire apparatus can be relatively small.

Moreover, according to still another aspect of the present invention, there is provided an image forming system that includes a stacker according to the present invention and an image forming apparatus that is coupled with the stacker and discharges sheets into the stacker.

With this configuration, even when the stacker is added to a system, an amount of increase in the size of the entire system can be relatively small.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

The entire configuration of a stacker that includes a sheet aligning mechanism according to an embodiment of the present invention is described first, which is followed by description about configurations of a shift mechanism for shifting a sheet, a leading-end alignment mechanism for aligning leading ends of the sheets, a jogger mechanism for aligning side faces of the sheets, and a sub jogger mechanism for aligning side faces of large-sized sheets.

Figure 1:
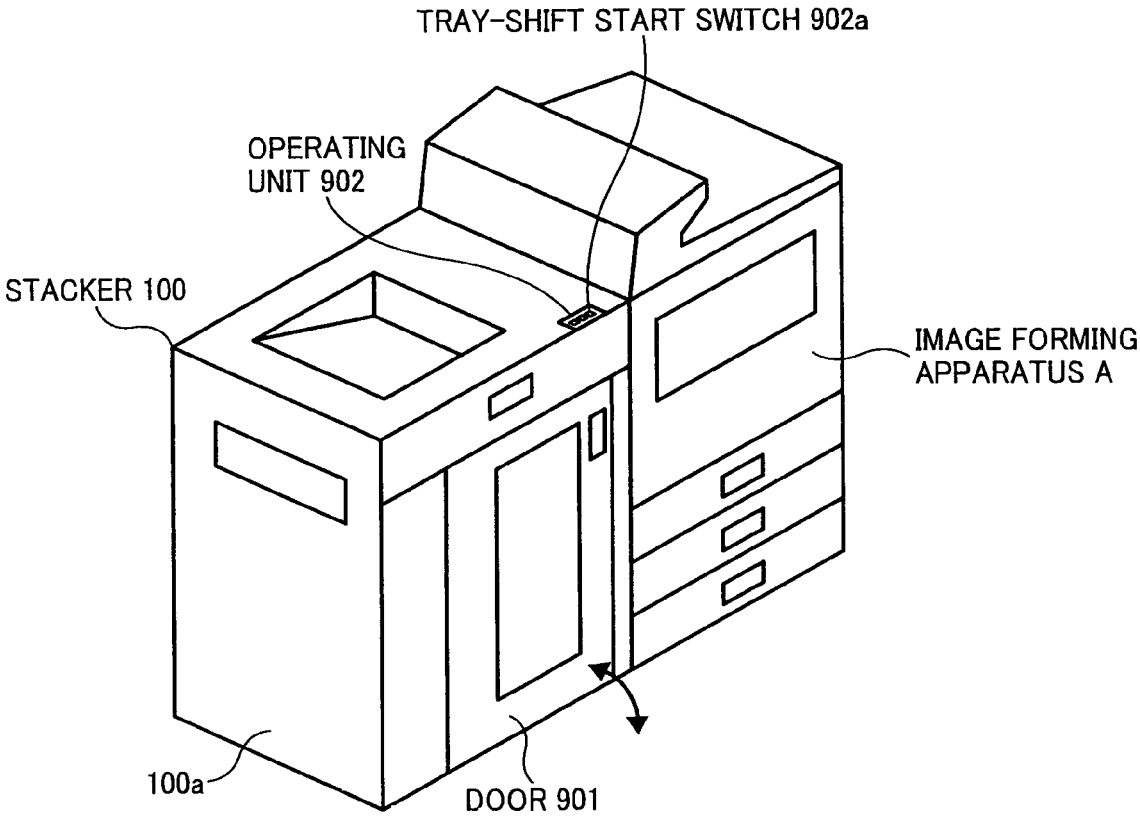
FIG. 1 is a schematic perspective view of a copying system that includes a stacker and an image forming apparatus for illustration of an embodiment of the present invention.

FIG. 1 is a schematic perspective view of a copying system that includes a stacker and an image forming apparatus for illustration of the embodiment.

An image forming apparatus A depicted in FIG. 1 is an image forming apparatus such as a copying machine, a facsimile machine, or a multifunction product providing functions of the copying machine and the facsimile machine, and includes a stacker 100, which is a sheet post-processing apparatus, on the side of a discharge opening, through which a sheet is to be discharged from the image forming apparatus A. The stacker 100 includes a stacker body 100*a* that includes a door 901 at a sheet removal portion and a door-opening detecting member (not shown) that detects whether the door 901 is open.

An operating unit 902 is provided on the stacker body 100*a* at an upper portion on the side where the door 901 is arranged. A tray-shift start switch 902*a* that is to be switched on when a sheet of paper is to be taken out from a shift tray, which will be described later, inside the stacker body 100*a*, a display element, and the like are provided on the operating unit 902. A sheet post-processing apparatus, such as another stacker or a finisher, can be connected to the backside of the stacker 100.

Figure 2:
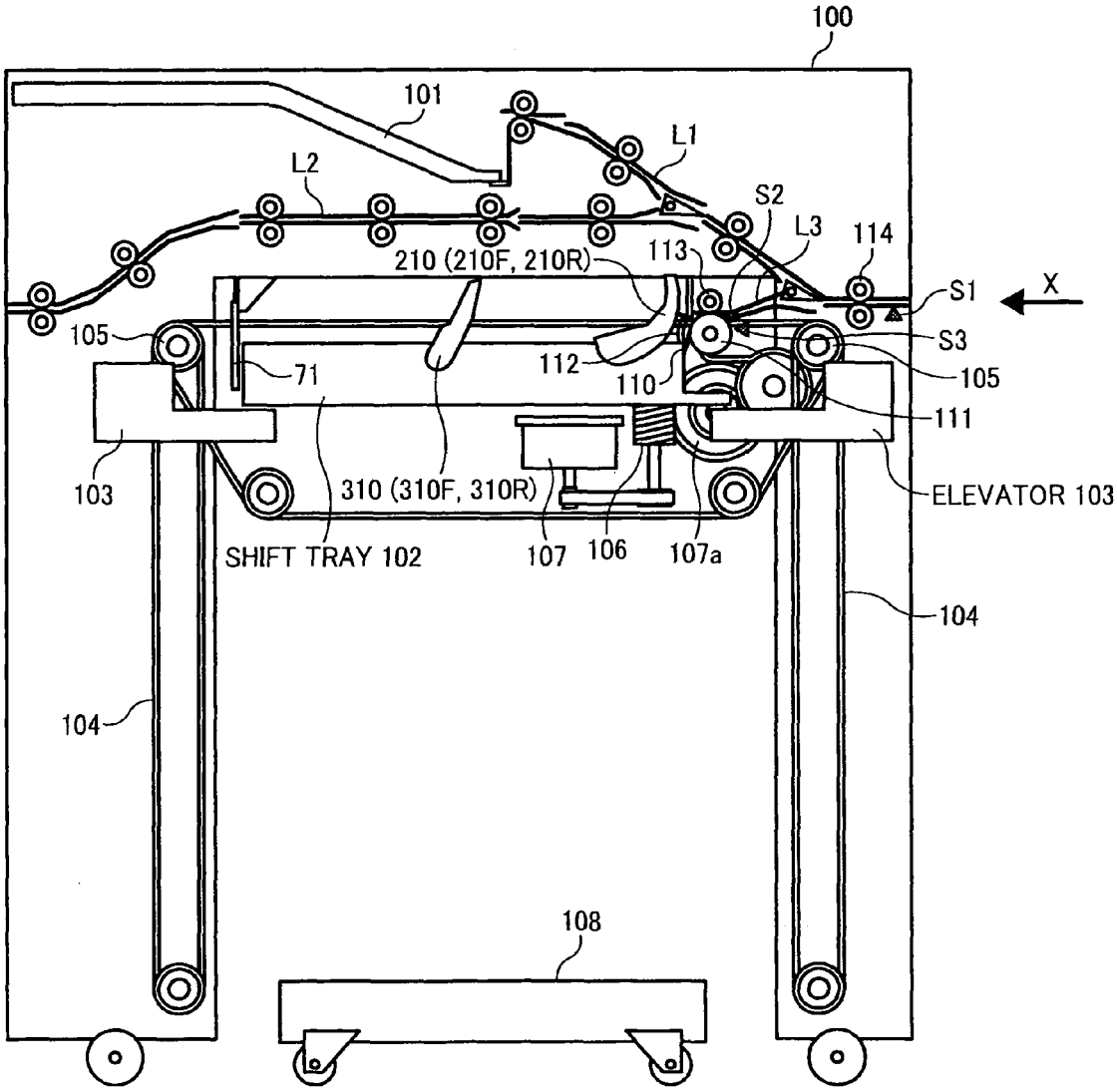
FIG. 2 is a schematic cross-sectional view of the stacker according to the embodiment.

FIG. 2 is a schematic cross-sectional view of the stacker according to the embodiment. A sheet of paper discharged from the image forming apparatus A is introduced into the stacker 100 in the direction indicated by arrow X (hereinafter, "direction X"). The stacker 100 offers a choice of an operating mode among a proof discharge mode, a straight discharge mode, and a shift discharge mode.

The proof discharge mode is an operating mode in which a sheet is guided through a sheet transport path L1 into a proof tray 101 to be stacked thereon. The straight discharge mode is an operating mode in which a sheet is guided through a sheet transport path L2 into a post-processing apparatus, such as another stacker, arranged downstream from the stacker. The shift discharge mode is an operating mode in which a sheet of paper is guided through a sheet transport path L3 into an elevatable shift tray 102 to be stacked thereon. In the shift discharge mode, sheets of paper are stacked at different shift positions on the shift tray 102.

The shift tray 102 is placed on an elevator 103 that can move up and down. The elevator 103 is suspended at its four corners by four timing belts 104 (two of them are depicted in FIG. 2). Each of the timing belts 104 is wound around a corresponding one of four timing-belt pulleys 105 (two of them are depicted in FIG. 2). The timing-belt pulleys 105 are linked together by a gear train 107*a* that includes a worm gear 106 and a plurality of gears and rotate synchronously on drive force fed from a tray elevating motor 107, thereby moving up and down the elevator 103 together with the shift tray 102. The worm gear 106 in this driveline allows to hold the shift tray 102 at a fixed position.

When the elevator 103 is lowered to a predetermined sheet-full position, the stacker 100 transmits a full-detection signal to the image forming apparatus A and stops accepting subsequent sheets (sheet-discharging out of the image forming apparatus A is stopped).

In this state, where the elevator 103 has not reached to a lowermost position yet and hence the shift tray 102 is not placed on a wagon 108, the tray-shift start switch 902*a* on the operating unit 902 depicted in FIG. 1 is switched on to lower the elevator 103 to the lowermost position. Placing the shift tray 102 onto the wagon 108 with the elevator 103 at the lowermost position allows to carry out the sheets stacked on the shift tray 102 together with the shift tray 102 by using the wagon 108.

When a job is completed before the elevator 103 reaches the full position, the elevator 103 can be lowered to the lowermost position similarly by switching on the tray-shift start switch 902*a* to allow sheets on the shift tray 102 to be taken out.

Reference numeral 110 denotes a paddle that rotates ganged with a sheet discharge roller 111 in the sheet transport path L3 and taps a trailing end of a sheet of paper discharged into the shift tray 102 to press the sheet downward against the shift tray 102. Reference numeral 112 denotes a filler that pushes up sheets of paper stacked on the shift tray 102. An optical sheet level sensor S3 detects a stack height of the sheets on the shift tray 102 based on motion of the filler 112.

When the sheet level sensor S3 is at an ON state, the tray elevating motor 107 is activated to lower the shift tray 102. When the sheet level sensor S3 enters an OFF state, the tray elevating motor 107 is stopped. Accordingly, the shift tray 102 is lowered by a predetermined distance each time the sheet level sensor S3 is brought into the ON state by the sheets of paper stacked on the shift tray 102.

In FIG. 2, reference symbol and numeral S1 denotes a sheet-transport passage sensor (hereinafter, "entrance sensor") arranged at a sheet entrance for detecting passage of a sheet of paper and S2 denotes a sheet-transport passage sensor (hereinafter, "sheet discharge sensor") for detecting passage of a sheet of paper in the sheet transport path L3. A driven roller 113 that is urged by a spring (not shown) is in pressure contact with the sheet discharge roller 111. A sheet of paper is to be nipped between these rollers 111 and 113. Reference numeral 114 denotes a pair of entrance rollers that are driven to deliver a sheet of paper discharged from the image forming apparatus A into the stacker 100.

Figure 3:
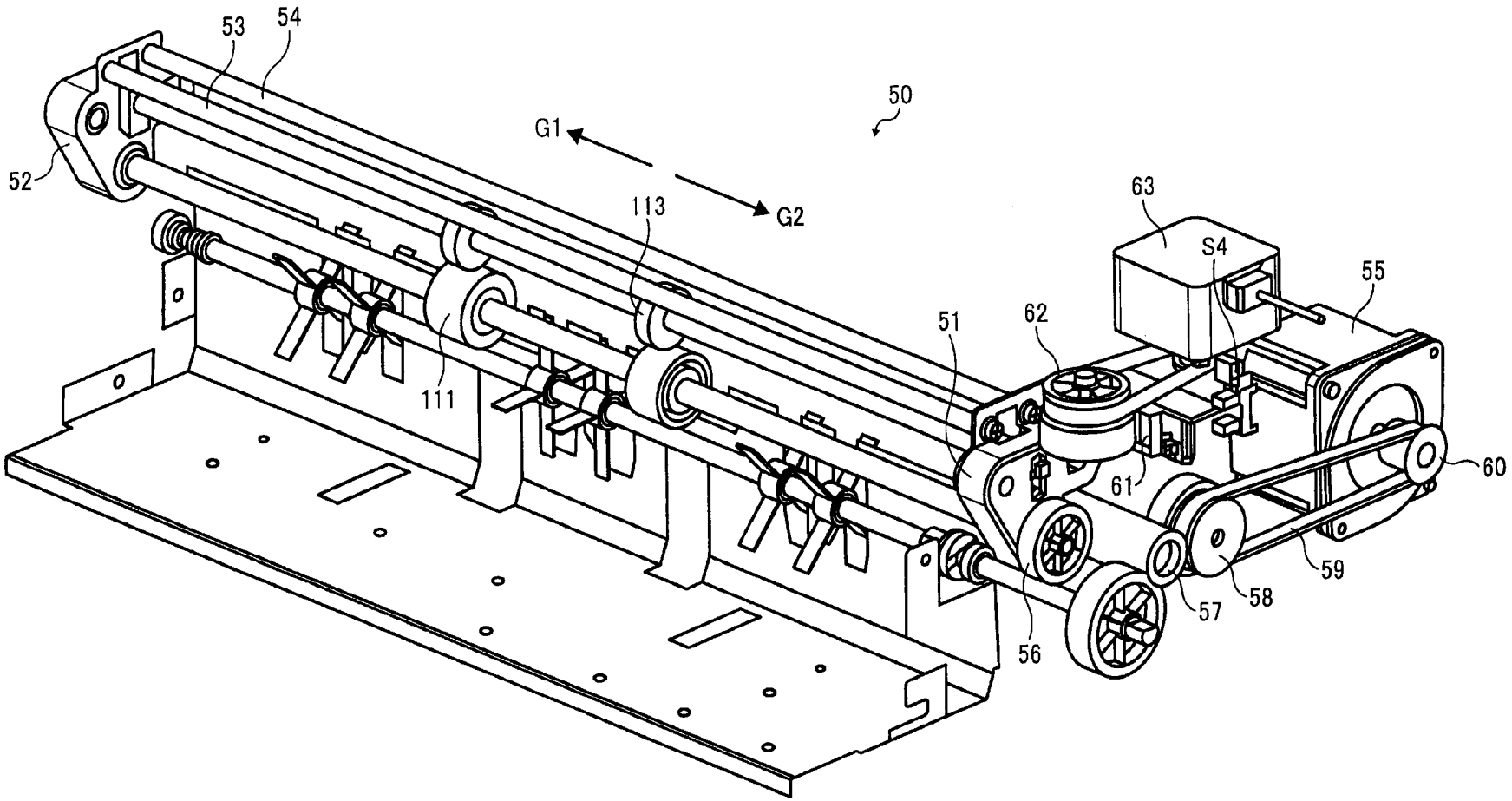
FIG. 3 is a schematic perspective view of a shift-transport mechanism unit according to the embodiment.

A shift-transport mechanism unit 50 depicted in FIG. 3 moves the sheet discharge roller 111 and the driven roller 113 in a direction indicated by arrows (arrow G1 is directed to a near side of the stacker 100 and arrow G2 is directed to a far side of the stacker 100) by a predetermined distance, thereby shifting a discharge position of a sheet of paper on the shift tray 102 toward or away from the near side.

Specifically, the sheet discharge roller 111 and the driven roller 113 are coupled to a holder 51 and a holder 52 that move in the direction indicated by arrow G1 (hereinafter, "direction G1") and the direction indicated by arrow G2 (hereinafter, "direction G2"), respectively, and to rods 53 and 54 that couple the holders 51 and 52 together. The sheet discharge roller 111 is rotated by a stepping motor 55 regardless of which one of the direction G1 and the direction G2 the sheet discharge roller 111 is to be moved. Specifically, a driven gear 56 attached to the sheet discharge roller 111 meshes with a drive pulley 60 that is rotated through gears 57 and 58 and a belt 59 by the stepping motor 55 regardless of which one of the direction G1 and the direction G2 the sheet discharge roller 111 is to be moved.

The holder 51 includes a rack gear 61 that is coupled to a shift motor 63 through a pinion 62. The sheet discharge roller 111 and the driven roller 113 are slid in the direction G1 or G2 in increments of a predetermined distance (in this example, in increments of ten millimeters) from a center position, which is the position depicted in FIG. 3. The sheet discharge roller 111 and the driven roller 113 are set to have a home position, which is to be detected by an optical home position sensor S4, at the center position. The sheet discharge roller 111 and the driven roller 113 are moved to a shift position by causing the shift motor 63 to run a predetermined amount with reference to the home positions.

Figure 4:
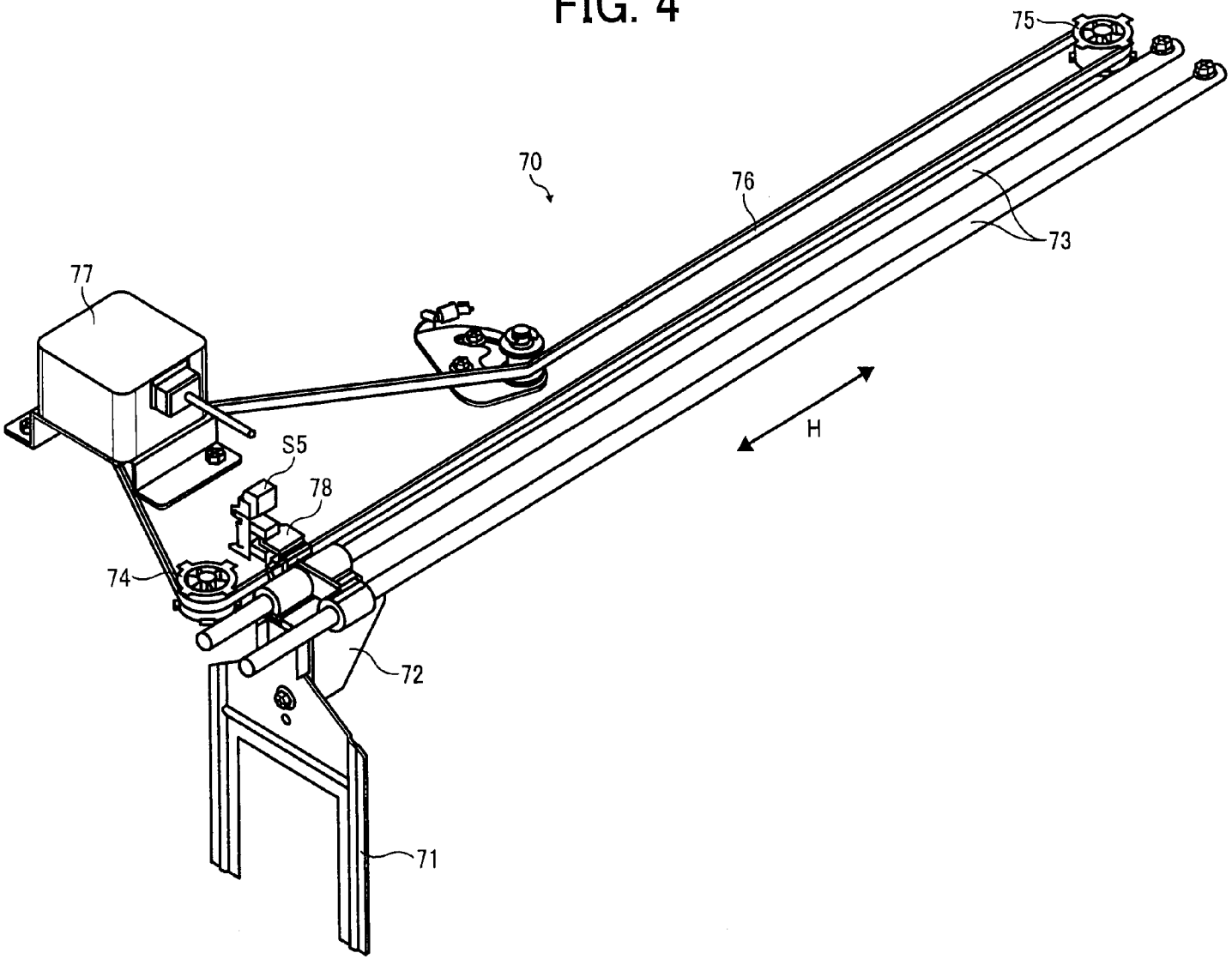
FIG. 4 is a schematic perspective view of a leading-end alignment mechanism unit according to the embodiment.

A leading-end alignment mechanism 70 depicted in FIG. 4 is a mechanism for aligning leading ends of sheets of paper discharged into the shift tray 102 and includes a stopper 71 whose position is adjustable in directions indicated by arrow H (hereinafter, "directions H"). The stopper 71 is attached to a slider 72. Shafts 73 that extend along arrow H guide the slider 72 for sliding motion of the slider 72 as depicted in the FIG. 4. The slider 72 is coupled to a belt 76 that is wound around pulleys 74 and 75. A stepping motor 77 drives the belt 76 to move, which causes the slider 72 to move together with the stopper 71 in one of the directions H for position adjustment.

The slider 72 includes a shield plate 78 that is to be detected by an optical home position sensor S5 when the stopper 71 is moved to a home position.

Figure 5:
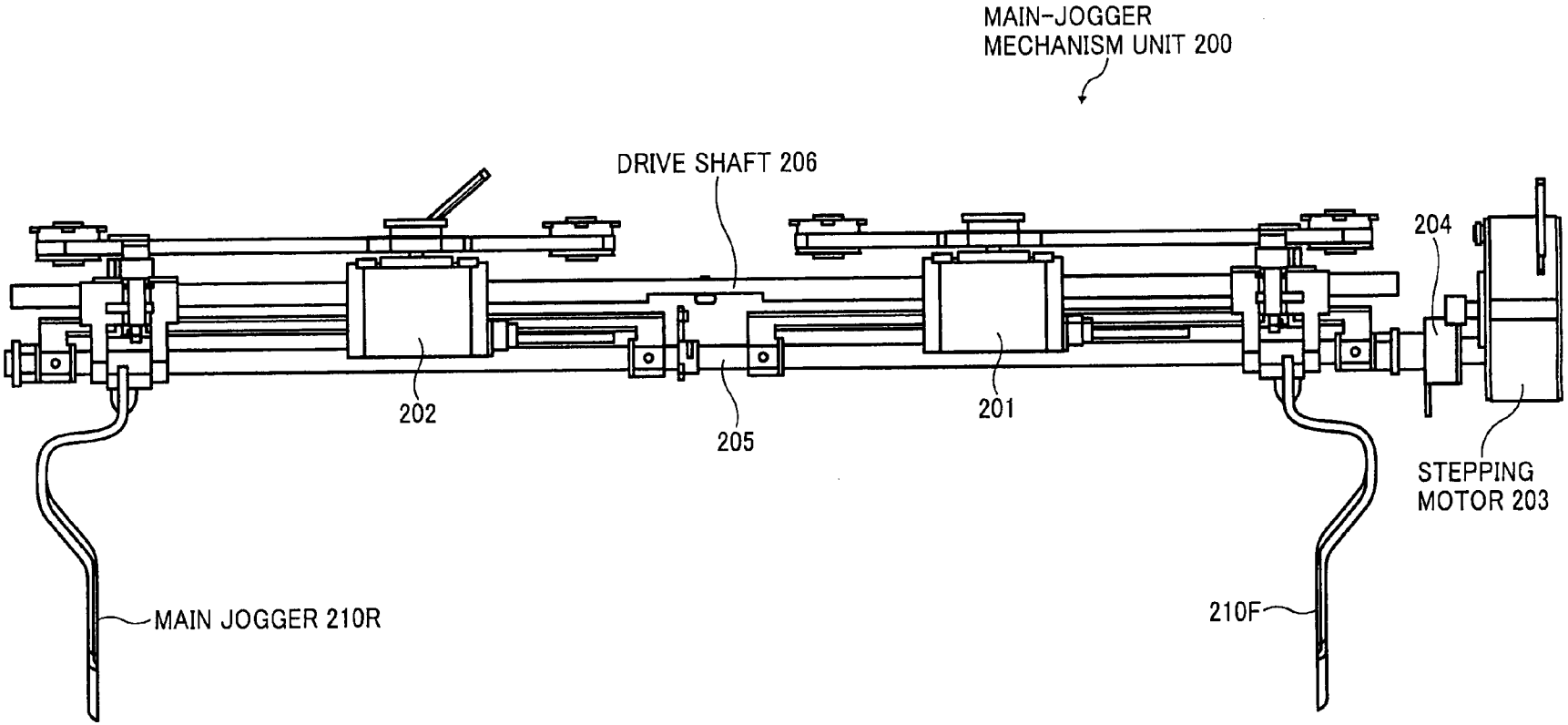
FIG. 5 is a schematic front view of a first width-direction aligning unit according to the embodiment.
Figure 6:
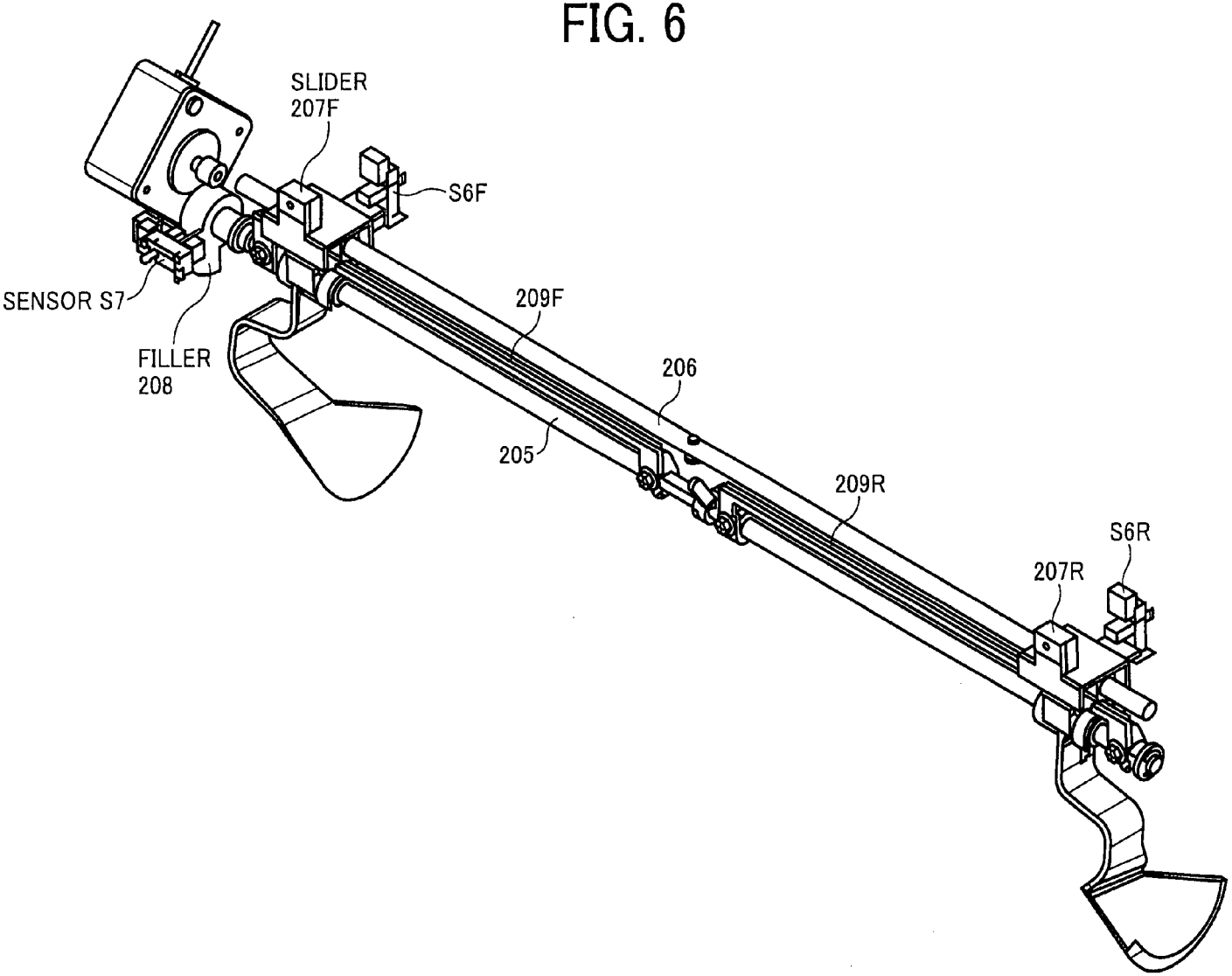
FIG. 6 is a schematic perspective view of the first width-direction aligning unit depicted in FIG. 5.
Figure 7:
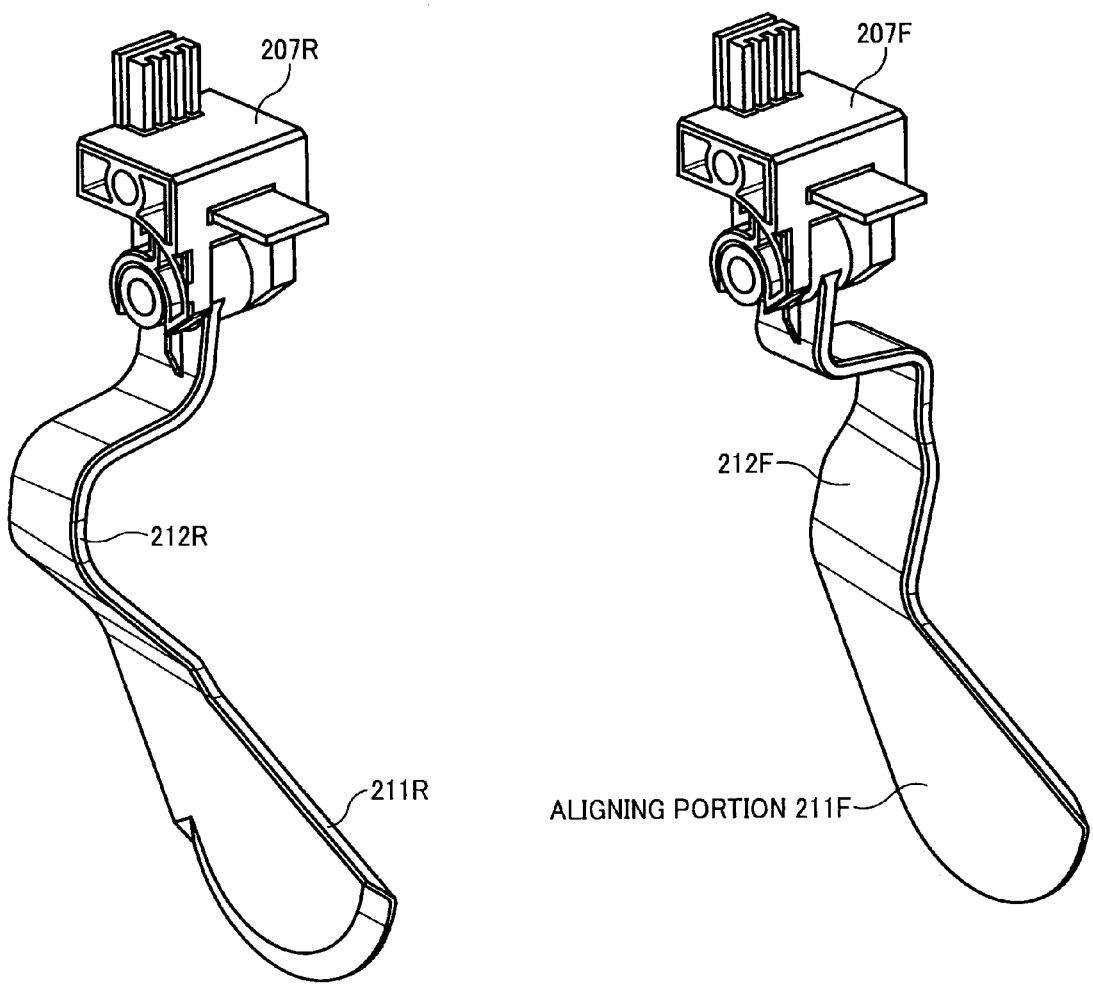
FIG. 7 is a schematic perspective view of a pair of aligning members of the first width-direction aligning unit according to the embodiment.

A main-jogger mechanism unit 200, which is a first width-direction aligning unit, depicted in FIG. 5 to FIG. 7 includes stepping motors 201 and 202 that control motion in the width direction (horizontal direction perpendicular to the sheet discharge direction), a stepping motor 203 that controls upward and downward motion, a gear 204 that meshes with an output gear (not shown) of the stepping motor 203, a rotary shaft 205 to which the gear 204 is attached, a drive shaft 206 parallel to the rotary shaft, sliders 207F and 207R coupled to the drive shaft 206, sensors S6F and S6R that detect the sliders 207F and 207R, a filler 208 arranged on the gear 204 to indicate a rotational state of the rotary shaft 205, and a sensor S7 that detects the filler 208. The main-jogger mechanism unit 200 moves main joggers 210F and 210R, which are aligning members, such that the main joggers 210F and 210R move toward or away from each other and upward and downward. A state in which the filler 208 is detected by the sensor S7 is the home position, where the main joggers 210F and 210R are downwardly orientated.

The main jogger 210F and the main jogger 210R, each of which is formed with a plate-like member, include an aligning portion 211F and an aligning portion 211R, respectively. The aligning portions 211F and 211R are positioned at lowermost portions of the main joggers 210F and 210R and face each other at flat surfaces extending perpendicular to the shift direction G.

As described above, the aligning portions 211F and 211R face each other at the flat surfaces that are perpendicular to the shift direction G. By virtue of this configuration, moving the main joggers 210F and 210R in the shift direction G causes the aligning portions 211F and 211R to come into or out of contact with end faces of sheets of paper stacked on the shift tray 102 without fail, thereby aligning the sheet stack of paper.

Portions positionally upper than the aligning portions 211F and 211R of the main joggers 210F and 210R are formed as stepped relief portions 212F and 212R such that a gap distance between the relief portions 212F and 212R is larger than a gap distance between the aligning portions 211F and 211R so that the main joggers 210F and 210R are prevented from interfering with a sheet of paper discharged from the sheet discharge roller 111 depicted in FIG. 2 when the sheet of paper is guided into the gap between the main joggers 210F and 210R.

The main joggers 210F and 210R are pinched between and pressed by the sliders 207F and 207R at root portions of the main joggers 210F and 210R. Accordingly, the main joggers 210F and 210R are configured so as not to be oriented downward further than a predetermined orientation depending on the positions of the sliders 207F and 207R but free to move upward.

The main joggers 210F and 210R are waiting at receiving positions away from each other at a predetermined distance to allow passage of a sheet of paper discharged from the sheet discharge roller 111.

Each time a sheet of paper is discharged from the sheet discharge roller 111 and stacked on the shift tray 102, the main joggers 210F and 210R move from the receiving positions toward each other to positions of end faces of the sheet of paper, and thereafter moves away from each other to return to the receiving positions. The main joggers 210F and 210R align the end faces of the sheets of paper by performing this sequence of alignment operations.

The sheet discharge roller 111 discharges a predetermined number of sheets that form a first sheet stack of paper while performing the shift operation of, in this example, ten-millimeter shift on each sheet of paper in the direction G1 depicted in FIG. 3. Thereafter, the sheet discharge roller 111 repeats the shift operation of ten-millimeter shift in the direction G2 to make a subsequent sheet stack of paper. When the shift direction is reversed, the main joggers 210F and 210R are moved to rotated-to-recede positions to enter an aligning-member-receded state. Under this receded state, the main joggers 210F and 210R perform the shift operation.

For example, when the sheet discharge roller 111 is to be shifted toward the main jogger 210F, the main jogger 210R is positioned so as to abut a far-side side face of discharged sheets stacked on the shift tray 102 and a top surface of a preceding batch (in units of sheet stacks of paper) of stacked sheets of paper. The main jogger 210F, which is the other one of the main joggers, is positioned at a near-side side face of the sheets of paper stacked on the shift tray 102 and vertically at its home position.

Each time the direction in which the sheet discharge roller 111 performs the shift operation is reversed, as depicted in FIG. 6, the rotary shaft 205 is rotated in a direction of causing arms 209F and 209R attached to the rotary shaft 205 to press the root portions of the main joggers 210F and 210R downward, thereby moving the main joggers 210F and 210R upward to the receded positions.

Each time the shift operation is to be performed, a discharged stack of sheets is aligned by causing the aligning member on the opposite side to come into contact with or be placed on a top surface of a preceding batch of stacked sheets of paper. Friction coefficients of the main joggers 210F and 210R are preferably set to such values with which the main joggers 210F and 210R are prevented from bringing the sheets of paper out of alignment so that sheets of paper can be aligned stably.

Upward receding of the main joggers 210F and 210R for removal a sheet of paper can performed by using an upward receding mechanism for use in the shift operation.

The amount of upward recession of the main joggers 210F and 210R is the amount of recession from the home position that is determined based on the result of detection of the filler 208 by the sensor S7. Therefore, the amount of upward recession is maintained constant. If a topmost surface ($+\alpha$) of a discharged stack is not moved (ascended) from the home position, the discharged stack can interfere (contact) with a subsequent sheet stack of paper to be discharged after being shifted, which causes the aligned sheet stack of paper to go out of alignment.

The ($+\alpha$) corresponds to a certain point between the home position and the position of the topmost surface. The larger the value of $\alpha$, a margin allowed for curl or an increase in thickness resulting from folding of a discharged sheet of paper increases; however, in a condition where an interval between sheets is small, a period of recovery time that elapses before acceptance of a subsequent sheet of paper is allowed undesirably increases.

A sub-jogger mechanism unit 300, which is a second width-direction aligning unit, will be described with reference to FIG. 8 to FIG. 13.

Figure 8:
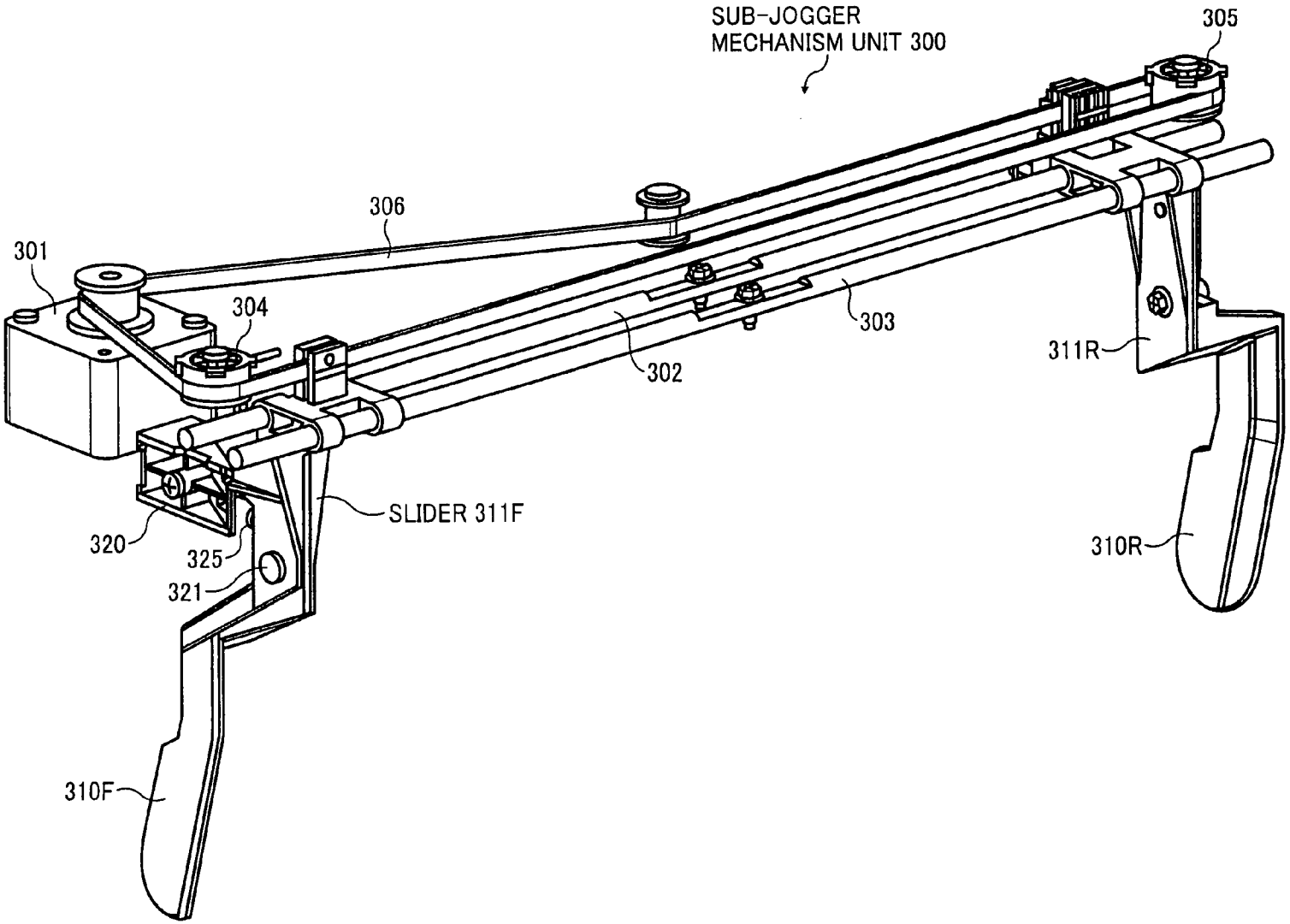
FIG. 8 is a schematic perspective view of a second width-direction aligning unit according to the embodiment as viewed from a front-right side of the stacker.
Figure 9:
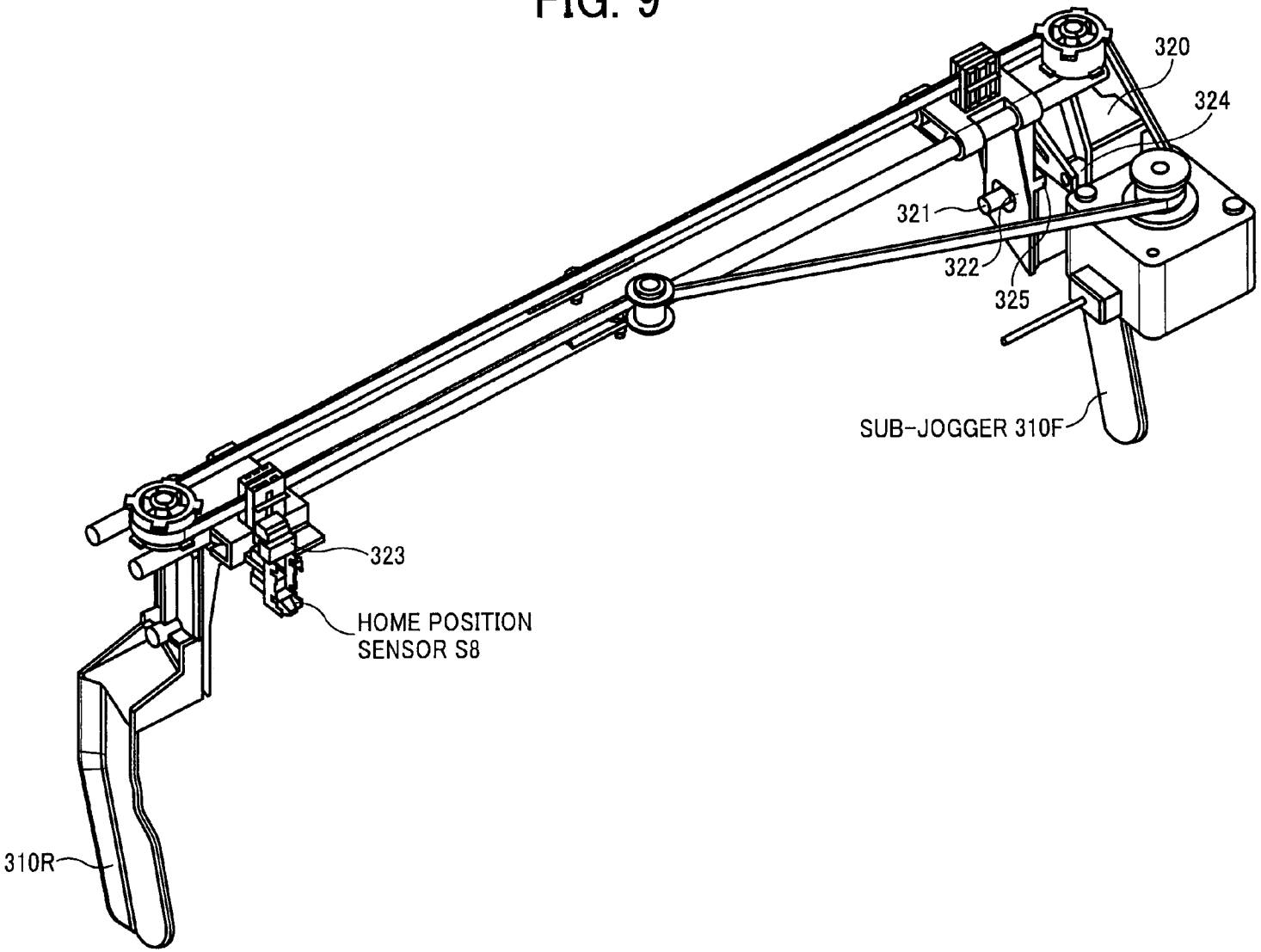
FIG. 9 is a schematic perspective view of the second width-direction aligning unit according to the embodiment as viewed from a rear-left side of the stacker.

FIG. 8 is a schematic perspective view of the sub jogger unit as viewed from a front-right side (main body side, sheet receiving side) of the stacker. FIG. 9 is a schematic perspective view of the sub jogger unit as viewed from a rear-left side (sheet discharging side) of the stacker.

The sub-jogger mechanism unit 300 is a mechanism that aligns a leading-end side face (aligns a side face on only a shift-discharged side) of (large-sized) sheets of paper discharged into the shift tray 102 and includes sub joggers 310F and 310R that are aligning members to be driven by a stepping motor 301 for position adjustment in the width direction.

The sub jogger 310F and the sub jogger 310R are attached to a slider 311F and a slider 311R, respectively. Shafts 302 and 303 that extend in the width direction guide the sliders 311F and 311R for sliding motion of the sliders 311F and 311R. The sliders 311F and 311R are coupled to a belt 306 that is wound around pulleys 304 and 305. The stepping motor 301 drives the belt 306 to move, which causes the sliders 311F and 311R to move together with the sub joggers 310F and 310R in the width direction.

The slider 311F includes a stopper 325 that is in contact with the sub jogger 310F when the sub jogger 310F is at an aligning position. By bringing the stopper 325 into contact with the sub jogger 310F, prevention against and reduction in the degree of rocking (swinging) motion are provided.

When the slider 311R is moved to its home position, an optical home position sensor S8 detects a detection plate 323 of the slider 311R.

Each of the sliders 311F and 311R moves at a speed that varies depending on a direction in which the slider moves from the home position. Because a strict limit is not imposed on a period of time with regard to the upward receding, it is set such that the aligning members are moved for the upward receding at a speed lower than a speed at which the aligning members are moved in the direction for alignment, thereby increasing a torque produced by the motor so that the upward receding that places additional load on the motor can be performed.

The sub jogger (sheet removing side) 310F is rotatably attached to the slider 311F with a rod 321 and a silencer 322 and downwardly oriented by gravity at a position where the sub jogger 310F performs the alignment operation (hereinafter, "aligning position").

A rotation center of gravity of the sub jogger 310F is arranged such that when the sub jogger 310F is downwardly oriented under a weight of a distal end portion of the sub jogger 310F, the center passes through the aligning position, and the sub jogger 310F is in constant contact with the stopper 325 of the slider 311F. This positionally stables the sub jogger 310F at the aligning position. The sub jogger 310F further includes a projection 324 that extends outward (toward the front of the stacker, away from the aligning position) and parallel to the moving direction of the slider 311F. A sloped guide 320 that is a guide for the projection 324 is provided so as to oppose the projection 324 at a position in an unmovable portion of the slider 311F near a front-side (outer side) end of a moving range of the slider 311F.

These configurations allow the slider 311F to move such that when the slider 311F moves to an end portion on the front side of the stacker, the projection 324 of the sub jogger 310F moves while being guided by the sloped guide 320, causing the sub jogger 310F to upwardly recede.

Unlike the main joggers 210F and 210R, the sub jogger 310F aligns only the side face on only the shift-discharged side rather than aligns side faces on the F side (front side) and the R side (rear side) of each discharged sheet of paper. This eliminates the need of causing the sub jogger 310F to upward recede for the shift operation. Therefore, the sub jogger 310R is not required to include an upward receding mechanism. A requisite for the sub jogger 310F is only to recede upward only when a sheet of paper is to be removed.

Figure 10A:
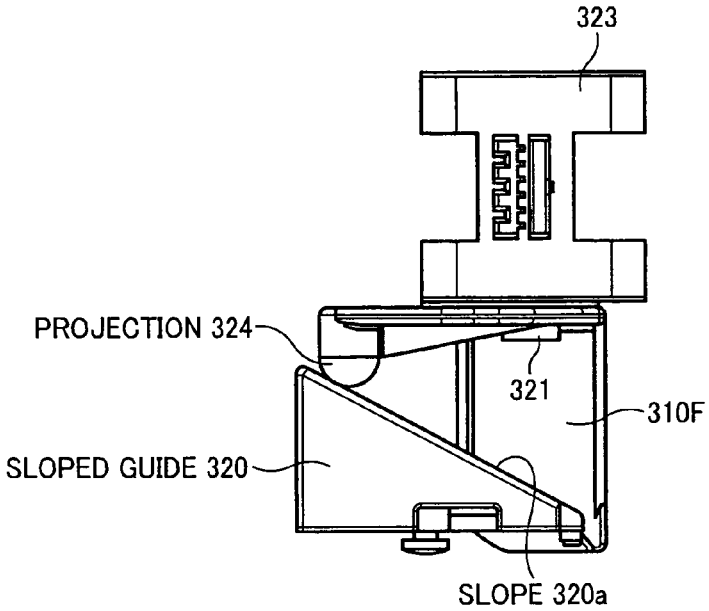
FIGS. 10A to 10C are a schematic plan view, a schematic front view, and a schematic side view, respectively, showing an aligning member of the second width-direction aligning unit in a state of not being upwardly receded.

Upward receding of the sub jogger 310F will be descried with reference to FIG. 10A to FIG. 13. FIG. 10A, FIG. 11A, and FIG. 12A are schematic plan views, FIG. 10B, FIG. 11B, and FIG. 12B are schematic front views, and FIG. 10C, FIG. 11C, and FIG. 12C are schematic side views.

Figure 10B:
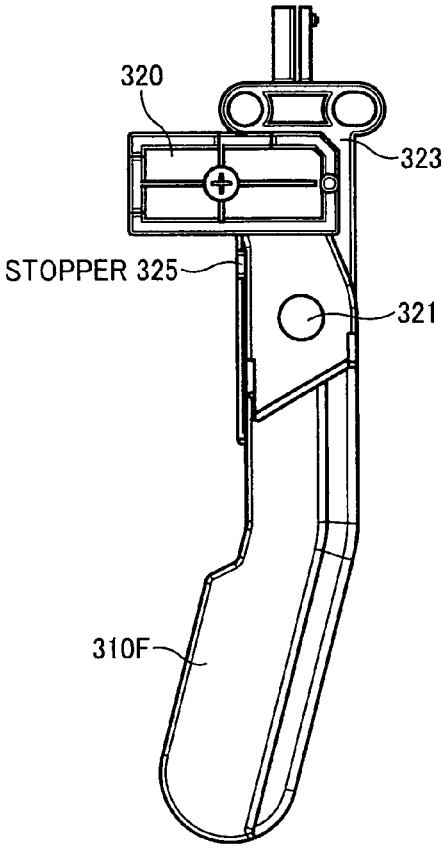
Figure 10C:
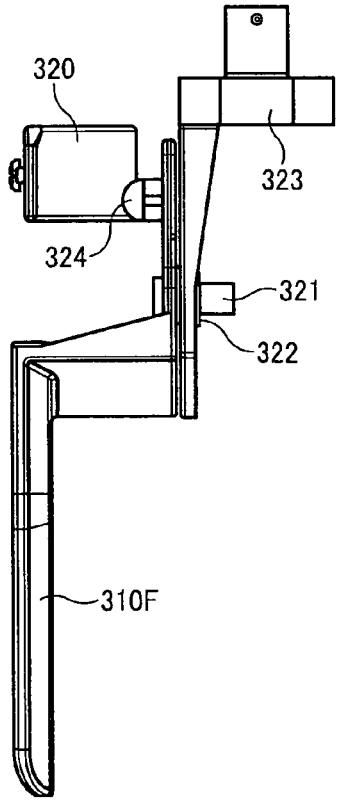

FIGS. 10A to 10C depict a state in which the sub jogger 310F is at its home position in the width direction, where the sub jogger 310F is not upwardly receded. FIG. 10A is the front view depicting a state where the projection 324 is in contact with a slope surface 320*a* of the sloped guide 320.

Figure 11A:
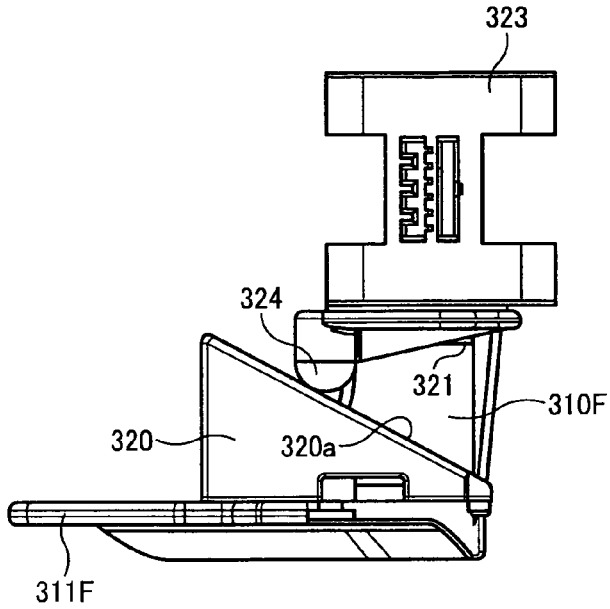
FIGS. 11A to 11C are a schematic plan view, a schematic front view, and a schematic side view, respectively, showing the aligning member of the second width-direction aligning unit on its way of being upwardly receded.
Figure 11B:
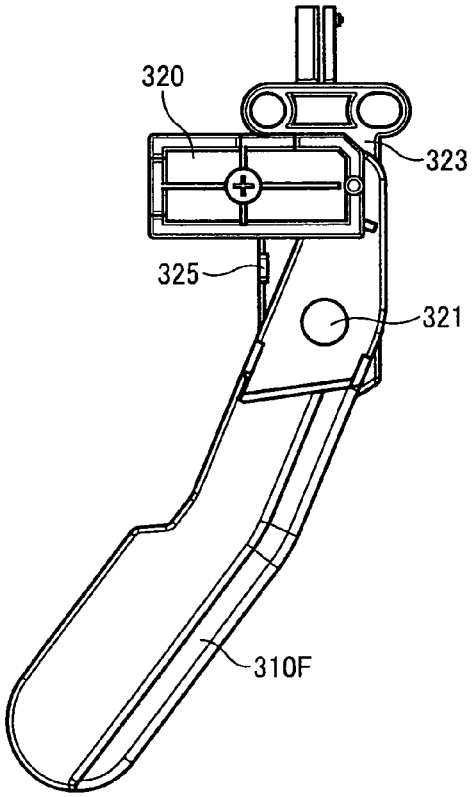
Figure 11C:
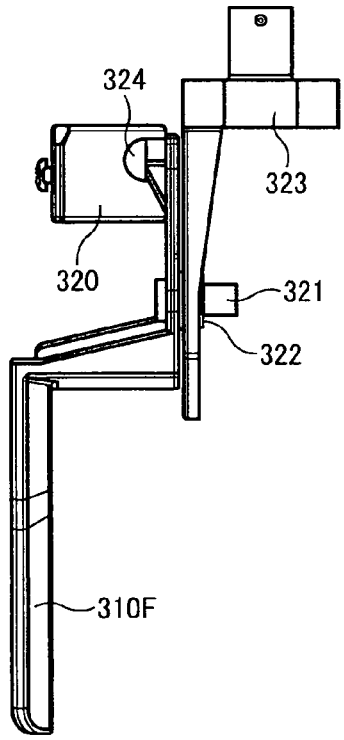

FIGS. 11A to 11C depict a state where the sub jogger 310F is on its way of being upwardly receded. Because the sub jogger 310F is rotatably attached to the slider 311F, when the slider 311F is moved to the front side of the stacker, the projection 324 of the sub jogger 310F is moved while being guided by the slope surface 320*a* of the sloped guide 320, causing the sub jogger 310F to rotate upward.

Figure 12A:
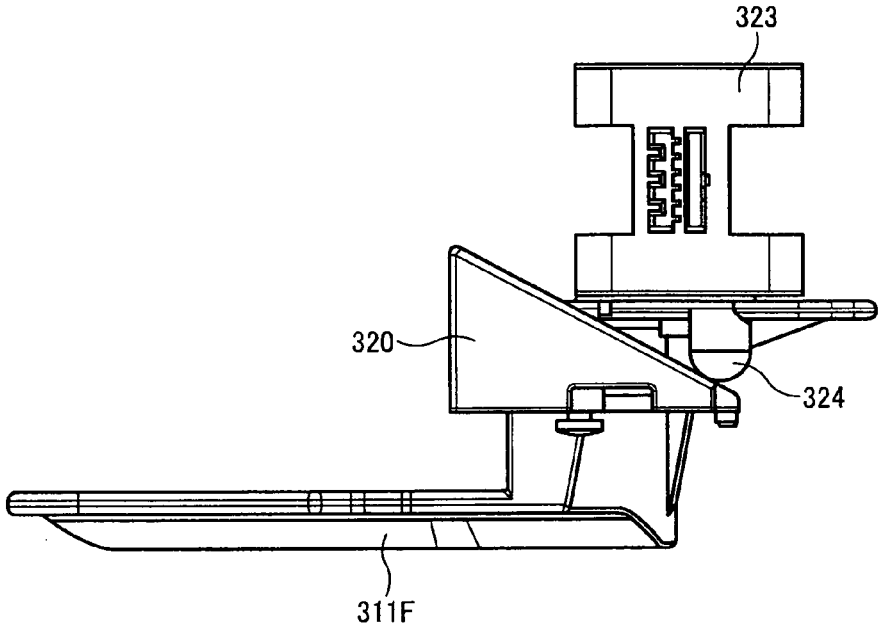
FIGS. 12A to 12C are a schematic plan view, a schematic front view, and a schematic side view, respectively, depicting the aligning member of the second width-direction aligning unit in a state of having been upwardly receded.
Figure 12B:
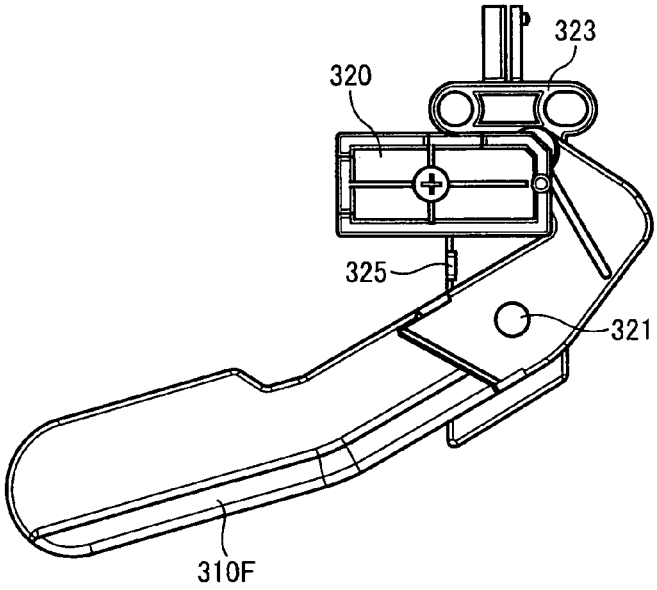
Figure 12C:
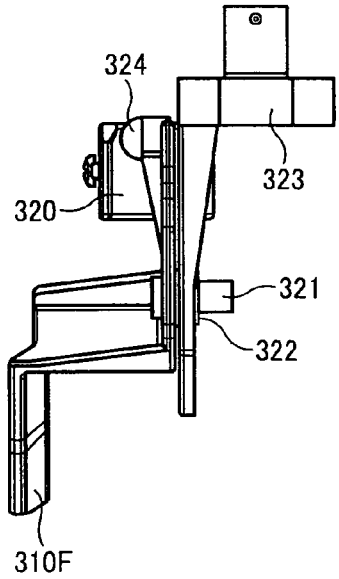

FIGS. 12A to 12C depict a state in which the slider 311F has reached the front-side (outer side) end portion of the moving range, where the sub jogger 310F has upwardly receded.

Figure 13:
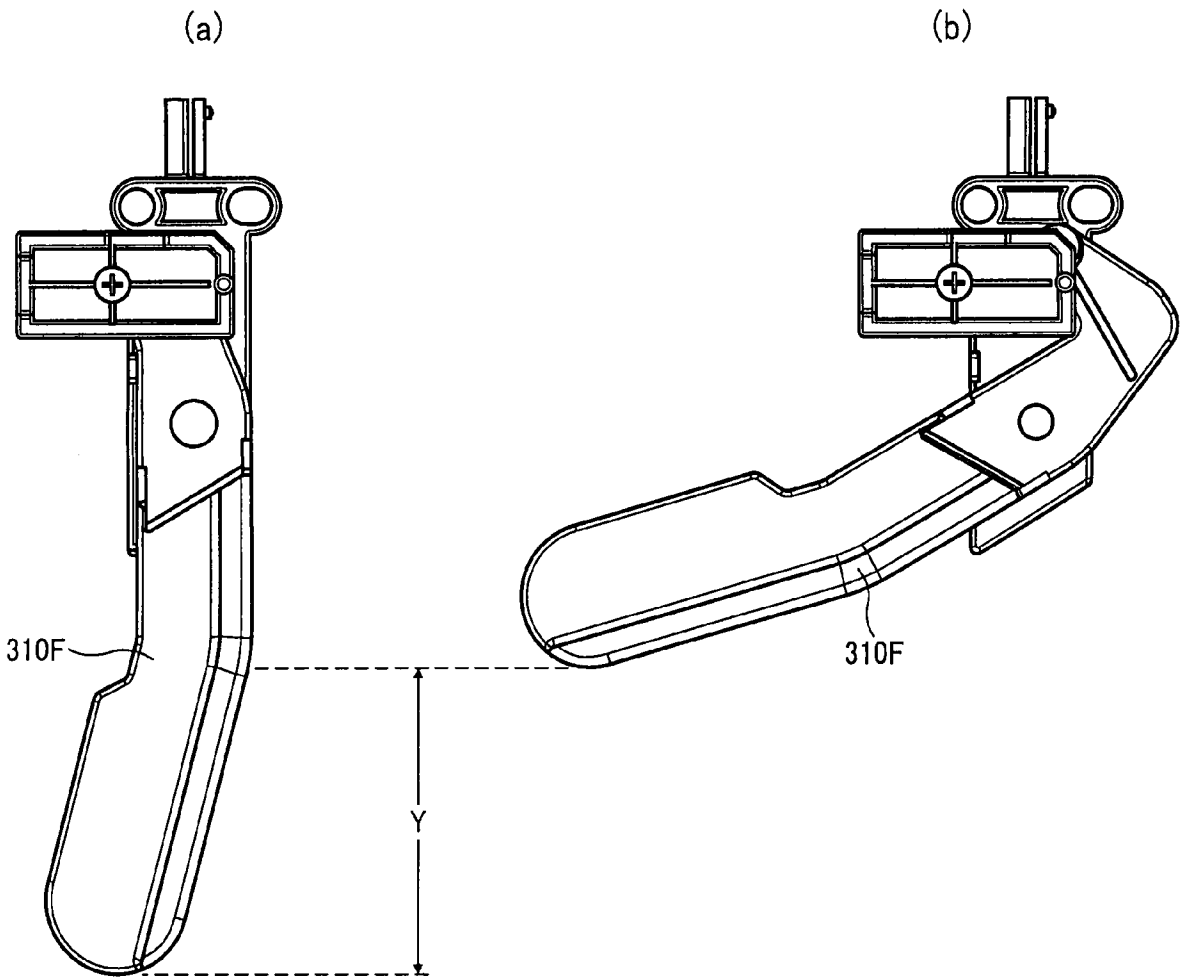
FIG. 13 is a schematic view of the aligning member of the second width-direction aligning unit in the state of not being upwardly receded (a) and in the state of having been upwardly receded (b).

FIG. 13 (*a*) depicts a state where the sub jogger is not at the upwardly receded position. FIG. 13 (*b*) depicts a state where the sub jogger is at the upwardly receded position. The difference in height between the two states corresponds to a space opened up by the upward receding of the sub jogger 310F and can be used not only for removal of a sheet of paper but also for other purposes.

The main joggers 210F and 210R and the sub joggers 310F and 310R, which are the first width-direction aligning unit and the second width-direction aligning unit, can be configured to upward recede when the tray-shift start switch 902*a* depicted in FIG. 1 is switched on or when the door-opening detecting member has detected that the door 901 is open.

In order that the upward receding is performed without fail by the main joggers 210F and 210R and the sub joggers 310F and 310R, which are the aligning members, it is desirable that the upward receding is performed in a state where each of the joggers outside a sheet-alignment operating range or that a sheet-width-direction detecting member is provided on the second width-direction aligning unit and the home position of each of the sub joggers 310F and 310R of the second width-direction aligning unit is set outside a sheet alignment range in the sheet width direction (direction perpendicular to the sheet discharge direction) and inside a position where the upward receding is performed.

Although the shift tray in the described embodiment is elevatable, the sheet aligning mechanism can be constructed by using a tray of other than an elevatable type.

It is conceivable to construct an image forming system by connecting the stacker according to the embodiment as a sheet post-processing apparatus to an image forming apparatus, which is a host apparatus, such as a copying machine or a printer, or to mount, or install, the stacker according to the embodiment on a sheet discharging unit inside the image forming apparatus. Each of the apparatus and the system that includes the sheet aligning mechanism according to the embodiment is capable of performing favorable stacking without involving upsizing.

According to one aspect of the present invention, an aligning member is upwardly receded from a sheet-alignment operating position, thereby lessening space that can be used only for sheet removal in a sheet aligning mechanism. This allows an increase in the number of sheets that can be loaded, compact construction of the apparatus, and allocating space opened up by lessening the space to space for removal of a jammed sheet or the like. Hence, the sheet aligning mechanism of favorable operability adapted to an intended use can be provided.

Furthermore, according to another aspect of the present invention, a stacker that has favorable operability adapted to an intended use and is easy to handle can be provided without involving upsizing.

Moreover, according to still another aspect of the present invention, an apparatus/system that performs stacking favorably can be provided without involving upsizing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet aligning mechanism that aligns sheets discharged from a sheet discharging unit into a tray, the sheet aligning mechanism comprising:

a first width-direction aligning unit arranged near the sheet discharging unit, for aligning end faces of the sheets in a sheet width direction perpendicular to a sheet discharge direction;

a second width-direction aligning unit arranged downstream of the first width-direction aligning unit in the sheet discharge direction, wherein each of the first width-direction aligning unit and the second width-direction aligning unit includes a pair of aligning members and each of the first width-direction aligning unit and the second width-direction aligning unit includes an upward receding mechanism that causes one of the aligning members to upwardly recede from a sheet-alignment operating position; and a drive unit that moves the aligning members of the first width-direction aligning unit and the second width-direction aligning unit in the sheet width direction and drives the upward receding mechanism to cause the aligning members of the second width-direction aligning unit to upwardly recede, wherein the upward receding mechanism of the second width-direction aligning unit includes a slider to which the aligning members are rotatably attached, the slider being driven by the drive unit, a projection arranged on one of the aligning members such that the projection extends parallel to a moving direction of the slider, and a sloped guide member arranged in an end portion of a moving range of the aligning member at a position where the sloped guide member opposes a distal end of the projection, and the projection is moved with the distal end in sliding contact with the sloped guide member, thereby rotating the aligning member to cause the aligning member to upwardly recede.

2. The sheet aligning mechanism according to claim 1, wherein the upward receding mechanisms of the first width-direction aligning unit and the second width-direction aligning unit cause at least an aligning member on a sheet removing side to recede.

3. The sheet aligning mechanism according to claim 1, wherein the upward receding mechanism of the second width-direction aligning unit causes an aligning member to upwardly recede when the aligning member is positioned outside a sheet-alignment operating range in the sheet width direction.

4. The sheet aligning mechanism according to claim 1, wherein a speed at which the aligning members move in the sheet width direction for sheet alignment is set to a value that is different from a speed at which the aligning members move in the sheet width direction for upward receding.

5. The sheet aligning mechanism according to claim 1, wherein the aligning member is configured to move within an alignment range and return to the sheet-alignment operating position by gravity when the distal end of the projection comes out of contact with the sloped guide member.

6. The sheet aligning mechanism according to claim 1, wherein the slider includes a stopper that comes into contact with the aligning member when the aligning member has returned to the sheet-alignment operating position by gravity.

7. The sheet aligning mechanism according to claim 6, wherein a rotation center of gravity of the aligning member is positioned so as to cause, when the aligning member returns from a receded position to the sheet operating position, the aligning member to return farther than the sheet operating position, thereby causing the aligning member to be kept in contact with the stopper of the slider.

8. The sheet aligning mechanism according to claim 1, wherein the second width-direction aligning unit includes a sheet-width-direction detecting member, and a home position of each of the aligning members is set to outside of a sheet alignment range in the width direction and inside a position where the aligning member upwardly recedes.

9. The sheet aligning mechanism according to claim 1, wherein the second width-direction aligning unit includes a sheet-width-direction detecting member, and a home position of each of the aligning members is set to a position where the aligning member upwardly recedes.

10. The sheet aligning mechanism according to claim 1, further comprising a shift unit that shifts batches of sheets to be discharged to different positions in the sheet width direction on a batch-by-batch basis.

11. A stacker that sequentially stacks sheets discharged from a sheet discharging unit into an elevatable tray, the stacker comprising a sheet aligning mechanism according to claim 1.

12. The stacker according to claim 11, further comprising a tray-shift start switch for starting shifting of the tray from a sheet stacking position to a sheet removal position when a sheet is to be removed, wherein the upward receding mechanism of the width-direction aligning unit of the sheet aligning mechanism is configured to be driven to perform an upward receding operation of the aligning member when the tray-shift start switch is switched on.

13. The stacker according to claim 11, further comprising:

a door arranged in a sheet removing unit of a stacker body; and a door-opening detecting member that detects whether the door is open, the door-opening detecting member being arranged in the stacker body, wherein the upward receding mechanism of the width-direction aligning unit of the sheet aligning mechanism is configured to perform an upward receding operation of the aligning member when the door-opening detecting member detects that the door is open.

14. An image forming apparatus that includes a stacker according to claim 11 inside a sheet discharge device.

15. An image forming system comprising:

a stacker according to claim 11; and an image forming apparatus that is coupled with the stacker and discharges sheets into the stacker.

16. A sheet aligning mechanism that aligns sheets discharged from a sheet discharging unit into a tray, the sheet aligning mechanism comprising:

a first width-direction aligning unit arranged near the sheet discharging unit, for aligning end faces of the sheets in a sheet width direction perpendicular to a sheet discharge direction; and a second width-direction aligning unit arranged downstream of the first width-direction aligning unit in the sheet discharge direction, wherein each of the first width-direction aligning unit and the second width-direction aligning unit includes a pair of aligning members and each of the first width-direction aligning unit and the second width-direction aligning unit includes an upward receding mechanism that causes one of the aligning members to upwardly recede from a sheet-alignment operating position, the second width-direction aligning unit includes a sheet-width-direction detecting member, and a home position of each of the aligning members is set to a position where the aligning member upwardly recedes.

17. A stacker that sequentially stacks sheets discharged from a sheet discharging unit into an elevatable tray, the stacker comprising:

a sheet aligning mechanism which aligns sheets discharged from a sheet discharging unit into a tray, the sheet aligning mechanism including:

a first width-direction aligning unit arranged near the sheet discharging unit, for aligning end faces of the sheets in a sheet width direction perpendicular to a sheet discharge direction; and a second width-direction aligning unit arranged downstream of the first width-direction aligning unit in the sheet discharge direction, wherein each of the first width-direction aligning unit and the second width-direction aligning unit includes a pair of aligning members and each of the first width-direction aligning unit and the second width-direction aligning unit includes an upward receding mechanism that causes one of the aligning members to upwardly recede from a sheet-alignment operating position; and a tray-shift start switch for starting shifting of the tray from a sheet stacking position to a sheet removal position when a sheet is to be removed, wherein the upward receding mechanism of the width-direction aligning unit of the sheet aligning mechanism is configured to be driven to perform an upward receding operation of the aligning member when the tray-shift start switch is switched on.

* * * * *